US005183092A

United States Patent [19]

Jelic

[11] Patent Number: 5,183,092

[45] Date of Patent: Feb. 2, 1993

[54] CORDING DESIGNS FOR OPERABLE ARCH WINDOW BLIND

[75] Inventor: Ralph Jelic, Valencia, Pa.

[73] Assignee: Verosol USA Inc., Pittsburgh, Pa.

[21] Appl. No.: 761,697

[22] Filed: Sep. 18, 1991

Related U.S. Application Data

[63] Continuation-in-part of Ser. No. 683,866, Apr. 11, 1991.

[51] Int. Cl.[5] ..... E06B 9/06

[52] U.S. Cl. ..... 160/84.1; 160/134

[58] Field of Search ..... 160/84.1, 134, 330, 160/368.1, 172

[56] References Cited

U.S. PATENT DOCUMENTS

| | | | |
|---|---|---|---|
| 451,068 | 4/1891 | Park . | |
| 823,096 | 6/1906 | Armstrong . | |
| 1,512,252 | 10/1924 | Verduin . | |
| 1,609,877 | 12/1926 | Kendall . | |
| 1,933,709 | 11/1933 | Cooper | 160/172 |
| 2,187,242 | 1/1940 | Kesner | 160/172 |
| 3,134,426 | 5/1964 | Cherubin . | |
| 4,699,195 | 10/1987 | Lester . | |
| 4,776,380 | 10/1988 | Lester . | |
| 4,825,611 | 5/1989 | Bassett . | |
| 4,858,669 | 8/1989 | Vinson . | |
| 4,934,434 | 6/1990 | Schnebly et al. . | |
| 4,934,436 | 6/1990 | Schnebly . | |
| 5,002,112 | 3/1991 | Schnebly et al. . | |

*Primary Examiner*—Blair M. Johnson

*Attorney, Agent, or Firm*—Buchanan Ingersoll; Lynn J. Alstadt

[57] ABSTRACT

An arch-shaped window blind assembly that uses pleated blind fabric placed between two bars pivotably connected by a slotted hinge. The blind assembly travels through the open and closed positions by the use of a slide that is connected to one of the bars. A cord is tied to the slide and the cord is knotted. The cord and knot travel through a channel in a track. In another embodiment, a spring load friction catch is provided on the end of at least one bar.

6 Claims, 8 Drawing Sheets

CORDING DESIGNS FOR OPERABLE ARCH WINDOW BLIND

RELATED APPLICATION

This application is a continuation-in-part of Ser. No. 683,866, filed Apr. 11, 1991.

BACKGROUND OF THE INVENTION

1. Field of the Invention

This invention relates generally to the field of blinds for use in windows and more particularly to collapsible blinds for use in arch-shaped windows.

2. Description of the Prior Art

Many buildings have windows that are arch shaped. Often it is desirable to prevent sunlight from directly entering the building through these arch windows. For these reasons, a number of blinds suitable for arch windows have been developed. Some designs such as are shown in U.S. Pat. No. 4,776,380 to Lester use venetian blinds. Venetian blinds have many slats making them relatively difficult to assemble, opaque and of distinctive appearance.

Simpler designs employ pleated material rather than venetian blind slats. Some pleated material designs use curved round rods such as shown in U.S. Pat. No. 1,609,877 to Kendall. Other designs require that supports be affixed into the window structure. These supports can be a plurality of hooks as shown in U.S. Pat. No. 4,825,611 to Basset or a mounting block as shown in U.S. Pat. No. 4,934,436 to Schnebly.

There is a need for a simplified blind for arch windows that uses pleated blind material and does not have many visible support rods, support hooks, cords or other readily noticeable support structure. Preferably, the blind should have no support rods or support hooks. The blind should be low cost, reliable, easy to assemble and easy to operate. Preferably, the blind should be capable of remote operation such as through use of a pull cord.

SUMMARY OF THE INVENTION

The present invention provides means for operating a blind for arch shaped windows. The preferred embodiment of the present invention utilizes a position slide moveably attached to one extending bar of the blind. A cord is attached to the position slide and a knot is then made in the cord. The cord and knot are placed within a channel located within the surrounding track. When the cord is pulled through the track, the bar travels arcuately in the direction in which the cord is pulled. The preferred manner in which to effectuate a pull on the cord is to lace each end of the cord through a ring and then fix each cord end to the track or to the surrounding structure.

DESCRIPTION OF THE PREFERRED EMBODIMENTS

Figure 1:
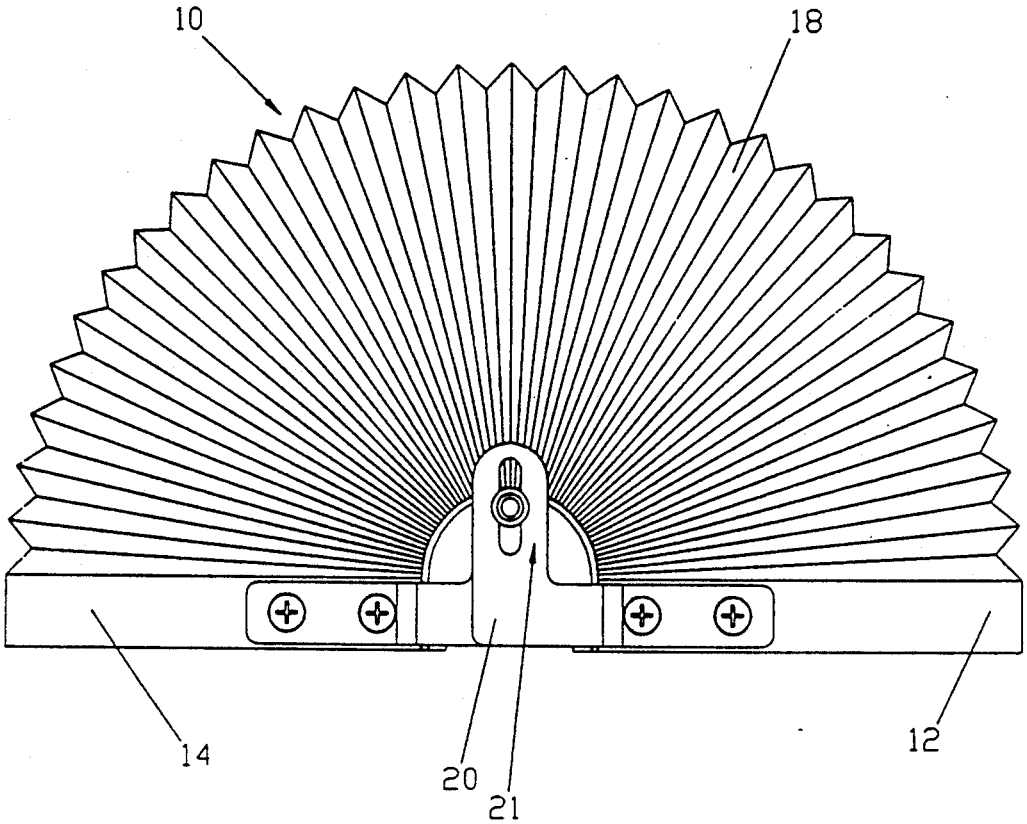
FIG. 1 is a back view of a present preferred embodiment in an open position.
Figure 2:
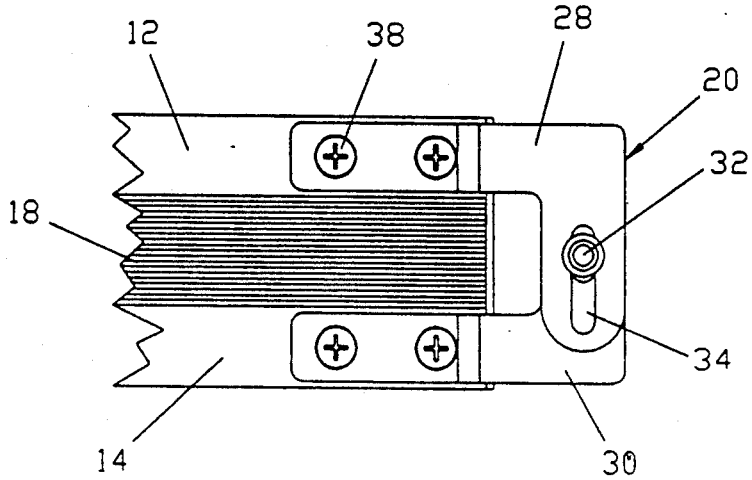
FIG. 2 is a back view of the present preferred embodiment of FIG. 1 with the blind assembly being in a stacked position and partially cut away.

Referring first to FIGS. 1 and 2, fan shaped blind assembly 10 has a traveling bar 12 and a fixed bar 14. Fixed bar 14 is secured to the track or the surrounding structure and is thus prevented from moving once put into position. A pleated or honeycomb blind panel 18 lies between traveling bar 12 and fixed bar 14. One side of blind panel 18 is fixed to traveling bar 12. The opposite side of blind panel 18 is fixed to fixed bar 14. A pivot means 20 is connected to the bottom of traveling bar 12 and fixed bar 14. When in the closed position, as shown in FIG. 2, pleated blind panel 18 collapses as the traveling bar 12 moves arcuately toward the fixed bar 14. Blind panel 18 opens as traveling bar 12 moves arcuately away from fixed bar 14, as is shown best in FIG. 1.

Figure 3:
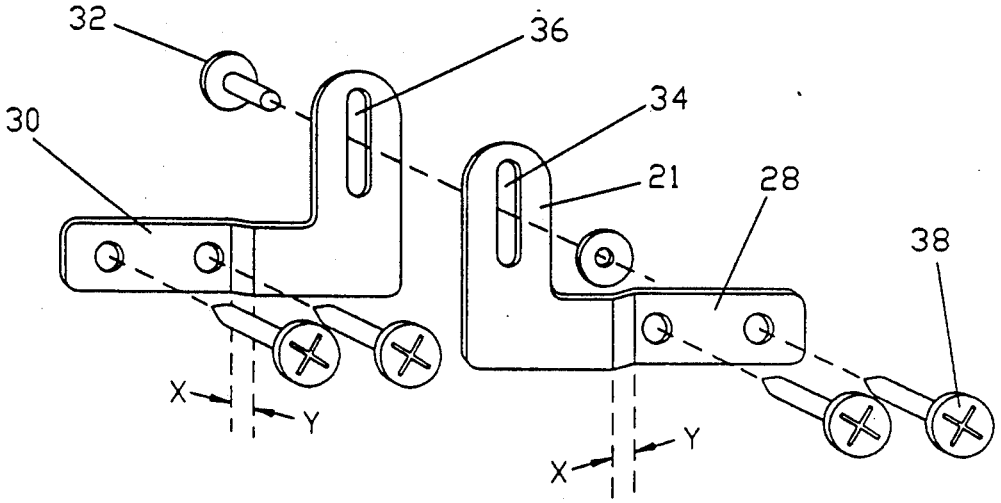
FIG. 3 is an exploded view of a preferred pivot means.

Referring next to FIGS. 2 and 3, pivot means 20 is shown having a first hinge segment 28 that is generally flat and L-shaped having an oval slot 34 lying on a portion of first hinge segment 28. A portion of first hinge segment 28 opposite the portion having oval slot 34 lies against and is fixed to traveling bar 12 in any convenient manner such as by the use of screws 38. A second hinge segment 30 is generally L-shaped and has an oval slot 36. A portion of each hinge segment 30 and 28 lying opposite from oval slot 36 is flat and lies against and is fixed to fixed bar 14 in any convenient manner such as by the use of screws 38. A portion of second hinge segment 30 designated by "x" and "y" respectively on FIG. 3, is curved so that the portion of the hinge segments having an oval slot 36 lies on a different plane than does the portion of the hinge segment that is fixed to the bar. When first hinge segment 28 and second hinge segment 30 are properly positioned and fixed to traveling bar 12 and fixed bar 14, respectively, the portions of first hinge segment 28 having slot 34 and second hinge segment 30 having slot 36 lie against one another with slots 34 and 36 overlapping somewhat. With first hinge segment 28 and second hinge segment 30 being in such position, there exists a space common to slots 34 and 36 that can accommodate a pin 32. With pin 32 positioned within slots 34 and 36, first hinge segment 28 can rotate about pin 32 relative to second hinge segment 30 and, thus, traveling bar 12 can move angularly relative to fixed bar 14. The oval shape of slots 34 and 36 provide pivot means 20 with an ability to accommodate a greater amount of blind panel 18 in blind apparatus 10. By being able to slide outward along the length of oval slots 34 and 36, pivot means 20 can widen, thus enabling the same pivot means 20 to be used for a variety of sizes of blinds. This sliding feature also allows the blinds to accommodate slightly non-circular motion for arch windows that are not perfect half circles. Because the pivot 20 is in a plane parallel to and adjacent the blind, the upright leg 21 and the head of pin 32 will provide support for the fabric. We have also found that one can cause the fabric to tilt relative to the bars 12 and 14 by bending leg 21 toward the fabric. Although the preferred embodiment of pivot means 20 includes a curved portion "x" and "y" in both hinge segments 30 and 28, the curved portion "x" might not be present. In that event, only the second hinge segment may be curved.

Figure 4:
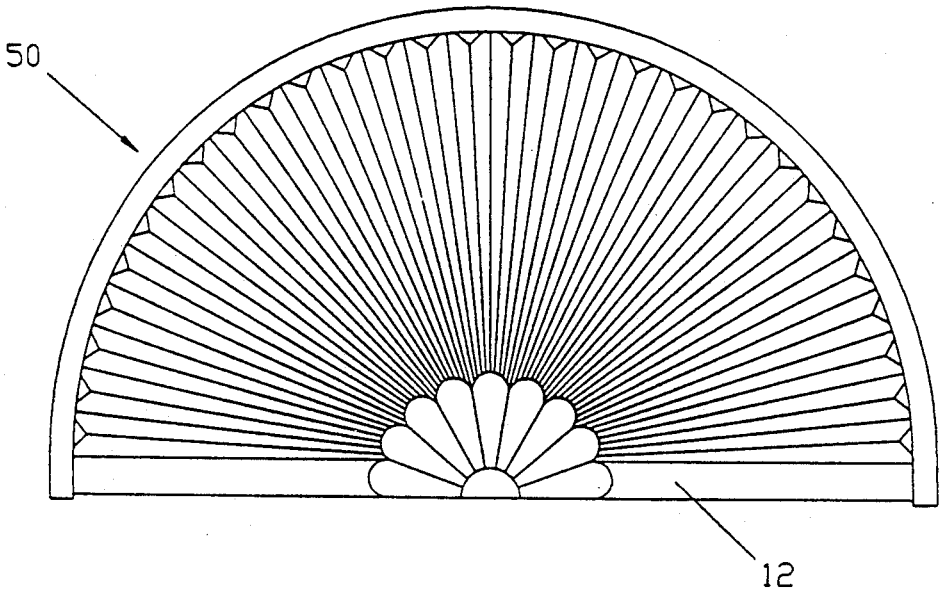
FIG. 4 is a front view of the operable arch window blind and track.
Figure 5:
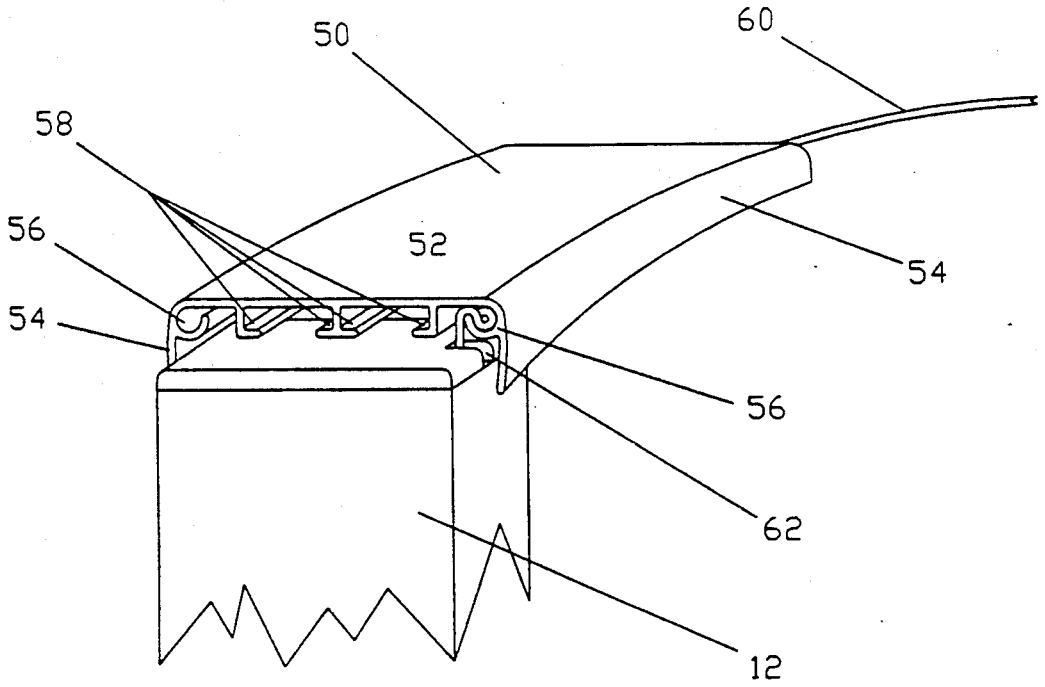
FIG. 5 is a perspective view of a portion of the blind and track of FIG. 4.

As shown in FIGS. 4 and 5, we prefer to provide a generally U-shaped track 50 having a base 52 and edges 54. Edges 54 are sufficiently large to fit over a portion of bars 12 and 14 and the blind panel attached therebetween. In at least one corner of the track, we provide a cord carrying channel 56 through which cord 60 travels. A knot 63 is made along cord 60. Knot 63 is placed within the cord carrying channel 56, thereby retaining cord 60 within channel 56. Cord 60 is fixed to bar 12 by any convenient means such as knotting cord 60 at its end and placing that knot within bar 12. In operation, bar 14 is fixed so that it cannot move relative to track 50. Bar 12 is not fixed and can move along track 50 arcuately either towards or away from bar 14 that is fixed. We prefer to provide guides 58 within the track 50. The track is preferably made of clear or light colored plastic so as to be not readily seen. The track should have some flexibility to conform to an arch shaped window frame. Tracks having these properties can be made from a clear UV cellulose acetate buterate. The track is attached to the frame in any conventional manner such as nails, screws or glue.

Figure 6:
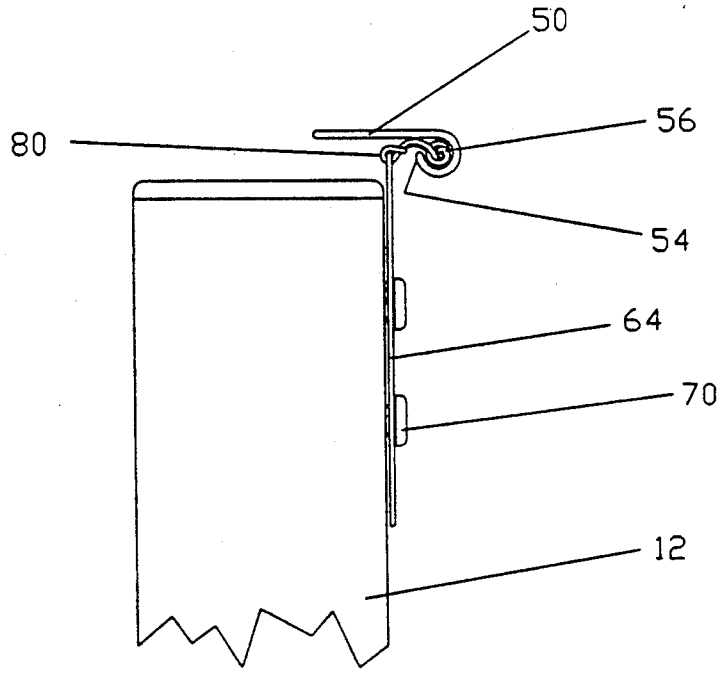
FIG. 6 is a side view partially in cross section of the preferred embodiment of the present invention.
Figure 7:
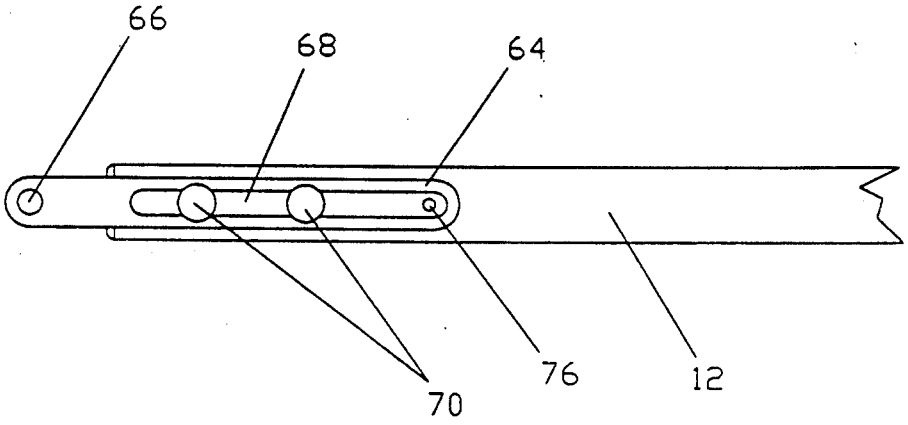
FIG. 7 is a rear view of a portion of the traveling bar having a position slide fastened thereto.

Referring to FIGS. 6 and 7, the preferred embodiment of the present invention utilizes a position slide 64 to connect traveling bar 12 to a cord which travels in track 50 and thereby moves traveling bar 12 to open and close the blind. Position slide 64 is elongated and generally flat having a cord tie off hole 66 located at one of its ends and an elongated slot 68 located at its other end.

Figure 8:
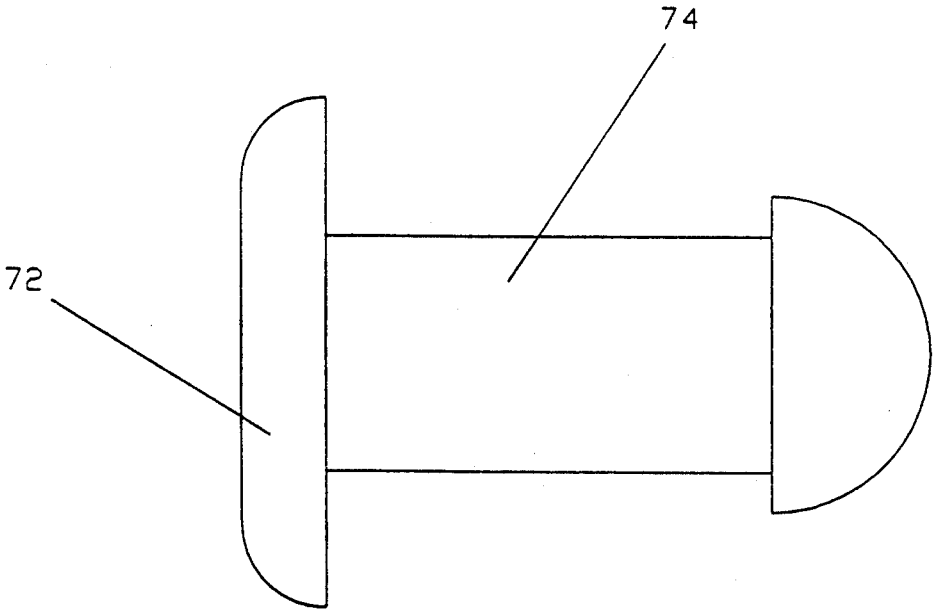
FIG. 8 is a side view of the button for fastening the position slide to the traveling bar.

As can be seen in FIG. 6, position slide 64 is attached to the back of traveling bar 12 adjacent to one of track edges 54. The surface of traveling bar 12 upon which position slide 64 is attached is referred to as the mounting face. Position slide 64 is attached to traveling bar 12 by means of at least two fasteners such as buttons 70. Shown in FIG. 8, buttons 70 have a head portion 72 and a stem portion 74. Buttons 70 are designed so that the diameter of stem portion 72 is less than the width of elongated slot 68 and further that the diameter of head portion 72 is greater than the width of elongated slot 68. Button holes 76 are drilled along the length of traveling bar 12. The distance between button holes 76 is preferably some amount less than the length of elongated slot 68. Position slide 64 is positioned against traveling bar 12 so that button holes 76 are within elongated slot 68. Once in position, buttons 70 are placed so that stem portions 72 pass through and are secured within button holes 76 and so that button heads 72 lie at some distance from the side of traveling bar 12 so as to prevent position slide 64 from moving in the direction away from traveling bar 12. When buttons 70 are thus in place, position slide 64 may travel along the length of traveling bar 12, being constrained in this travel by the contact between button stem portions 74 and the portions of position slide 64 adjacent to the ends of elongated slot 68. The amount of travel of position slide 64 is equal to the difference between the length of elongated slot 68 and the sum of the diameter of stem portion 74 and the distance between the two button holes 76. I prefer that the width of the slot 68 be close to the diameter of the button stems 74 to prevent transverse movement of the slide.

Figure 9:
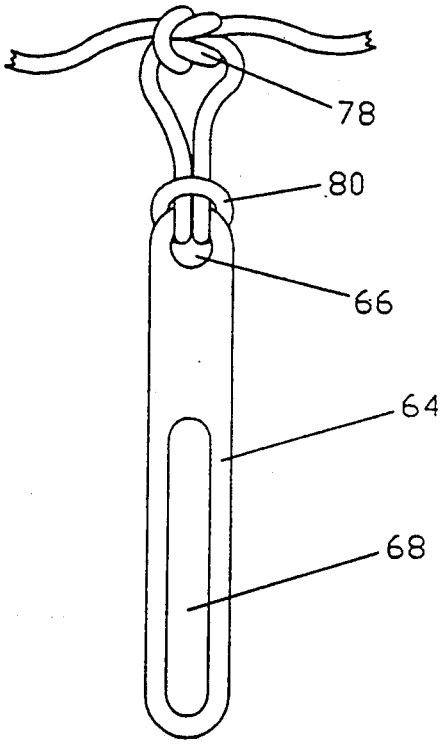
FIG. 9 is a plan view of the preferred means of fastening the position slide to the cord.

Referring now to FIG. 9, cord 60 travels through carrying channel 56 and is connected to position slide 64. This connection is made by supplying some slack in cord 60 and then making a square knot 78 so that the slacked portion of cord 60 is now in a looped configuration. A loop knot 80 is then made with the slacked portion of cord 60 through cord tie off hole 66.

Cord 60 and square knot 78 travel within carrying channel 56. Thus when an axial force is applied on cord 60 from one side of square knot 78, knot 78 will travel through carrying channel 56 of track 50 in the direction of the axial force. As square knot 78 travels arcuately about track 50, the slack in cord 60 between square knot 78 and loop knot 80 is taken up and position slide 64 and hence traveling bar 12 are moved arcuately about track 50 in the direction of the axial force. The ability of position slide 64 to slide along the length of traveling bar 12 allows for expansion and contraction of the blind assembly 10 without restriction. The oval slots 34 and 36 in pivot means 20 can thus freely expand or contract to accommodate various blind panel 18 dimensions. Furthermore, when a window is not a perfect half circle, position slide 64 may slide to facilitate the movement of traveling bar 12 through track 50.

Figure 10:
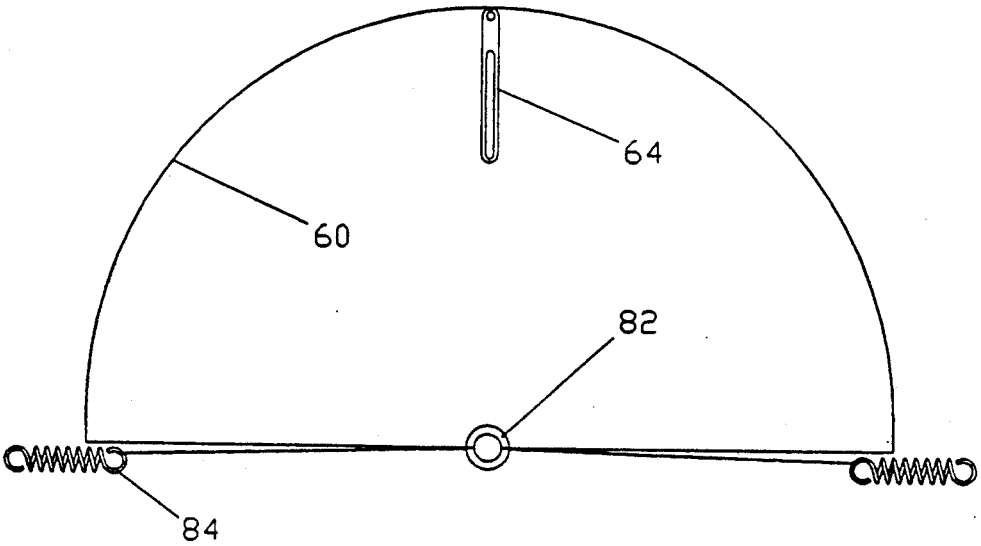
FIG. 10 is a front view of a first preferred cord configuration.
Figure 11:
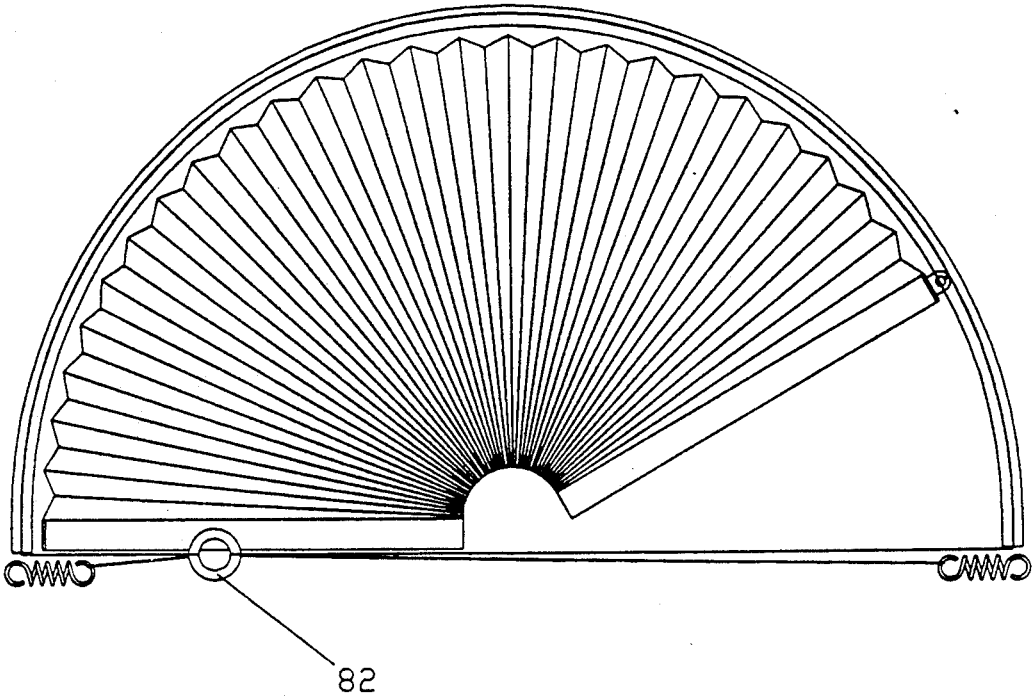
FIG. 11 is a front view of an arch blind with the cord configuration of FIG. 10 in a partially closed position.

Referring to FIG. 10, the preferred embodiment of the manner in which to apply an axial force upon cord 60 involves lacing the two ends of cord 60 through a ring 82 and then attaching the ends to opposite springs 84 which are fixed to the track 50 or to the surrounding structure. The length of cord 60 is chosen such that there is tension in cord 60. As ring 82 is moved either to the left or to the right, a force is applied on the cord in the direction of travel of ring 82. As ring 82 is moved to the left, it pulls the portion of cord 60 located to the right of ring 82 while simultaneously releasing the portion of cord 60 located to the left of ring 82. This movement causes traveling bar 12 to thereby unfold blind panel 18. Ring 82 is shown moved partly to the left so that blind panel 18 is partially unfolded. Movement of the ring 82 to the right will fold the blind panel 18.

Figure 12:
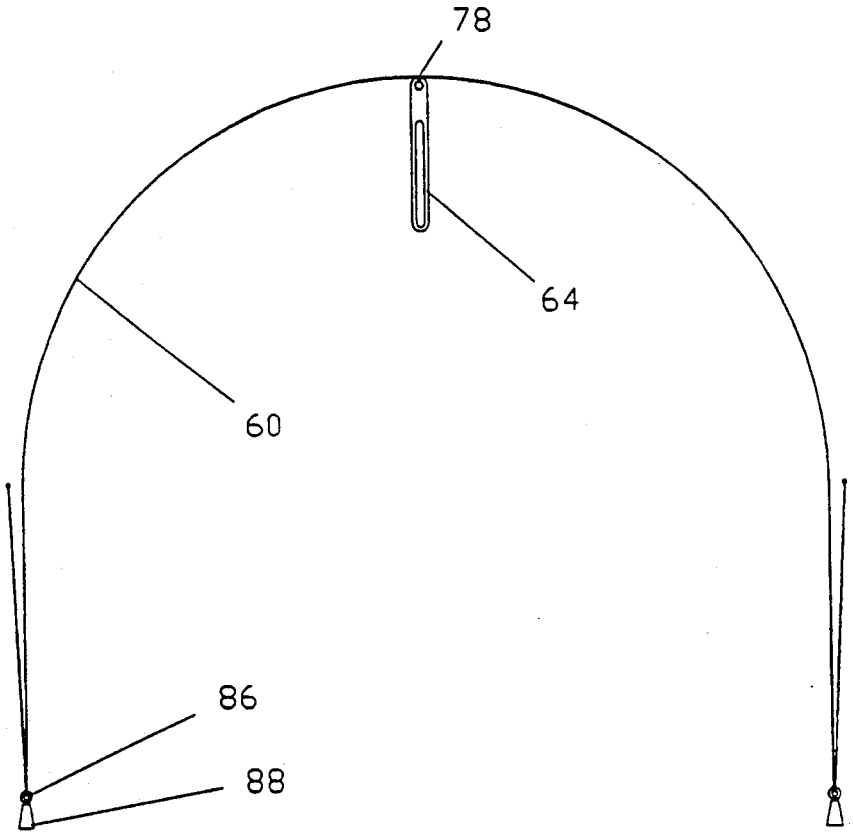
FIG. 12 is a front view of a second preferred cord configuration.

A second preferred arch blind uses a different cord configuration shown in FIG. 12. In this embodiment, the two ends of cord 60 are laced through individual rings 86 and are then fixed to the frame or the surrounding structure. Rings 86 may be equipped with tassels 88 or other handle means. Thus, when either tassel 88 is pulled, cord 60 and knot 78 will receive a force pulling the cord through channel 56 towards the pulled tassel. Thus, pulling a tassel will move traveling bar 12 toward that tassel.

Figure 13:
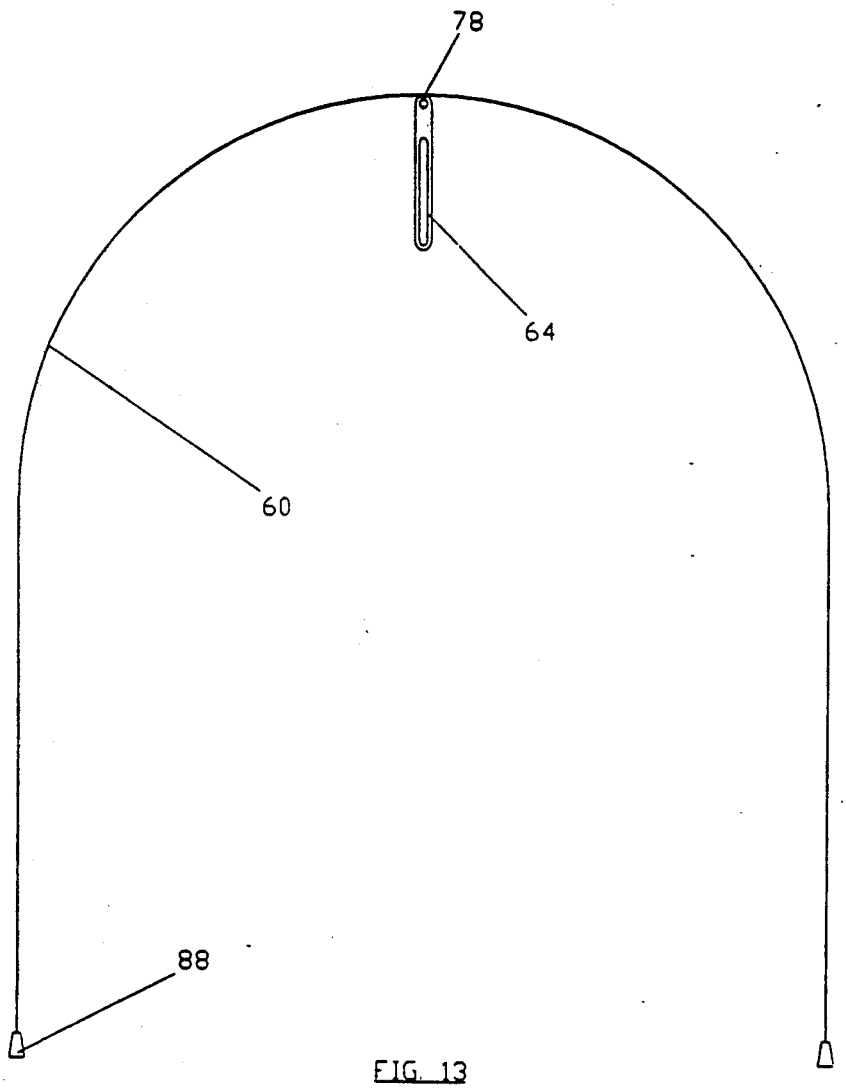
FIG. 13 is a front view of a third preferred cord configuration.

Another embodiment which uses a third cord configuration is shown in FIG. 13. In this embodiment, the two ends of cord 60 hang free. As either end of cord 60 is pulled, knot 78 will be pulled through channel 56 toward the pulled end. The slack in the portion of cord 60 between knot 78 and loop 80 will be picked up. Consequently, position slide 64 and attached traveling bar 12 will be moved along track 50.

Although position slide 64 is shown in the preferred embodiment to be connected to traveling bar 12 by buttons 70, any convenient means such as a rivet or a nut and bolt may be used. Furthermore, button head 72 need not be circular but may be any shape so long as the cross sectional area of head 72 is larger than the width of elongated slot 68.

The mounting face of traveling bar 12 is shown as the back face of bar 12. However, position slide 64 may be attached to any face of traveling bar 12. It is preferred that channel 56 be at a location within track 50 that is proximate to whichever face is chosen as the mounting face.

Figure 14:
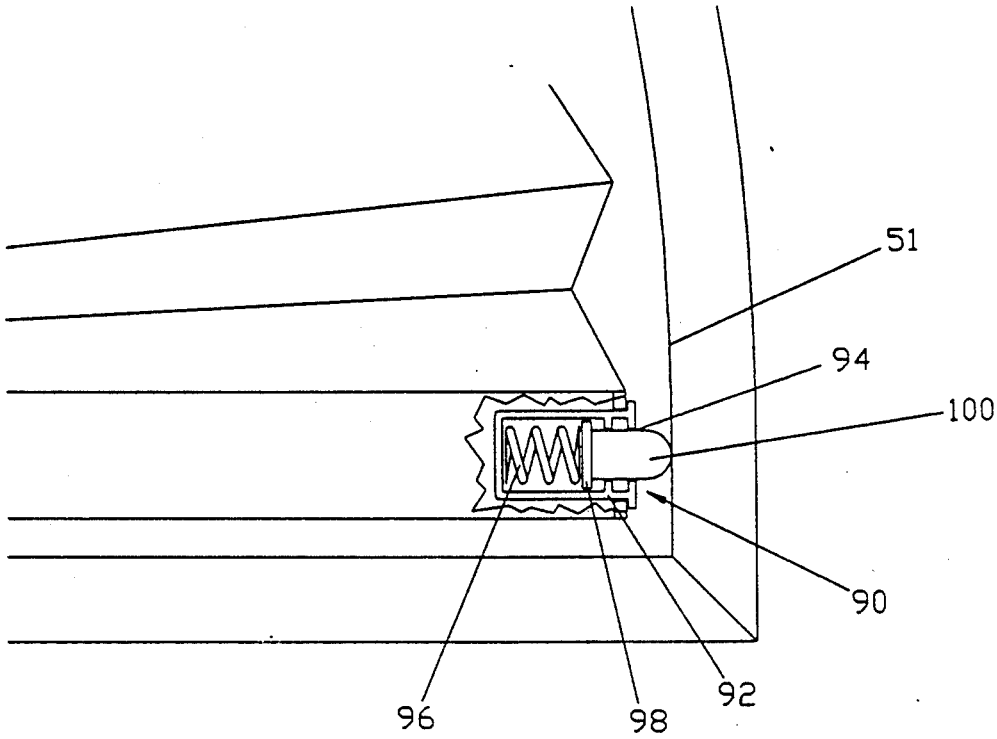
FIG. 14 is a front view partially cut away of a distal end of a traveling bar and attached fabric which utilizes a frictional catch against the track.
Figure 15:
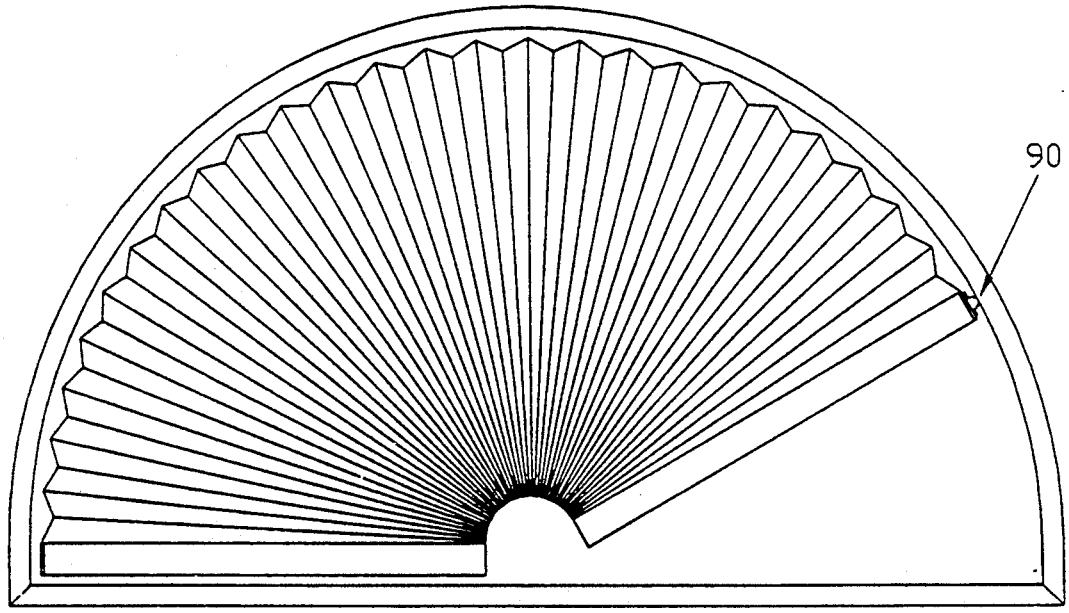
FIG. 15 is a front view of an arch blind having the frictional catch of FIG. 14 in a partially closed position.

Referring next to FIGS. 14 and 15, another embodiment of the present invention involves the use of a spring loaded frictional catch 90 which is attached within the end of traveling bar 12 farthest from pivot means 20. Catch 90 is constructed of a housing 92 which has an opening 94 at one end. Spring 96 is placed within housing 92 and a lip 98 is placed upon spring 96. Lip 98 is designed so as to have a length greater than the diameter of housing opening 94. Secured onto a face of lip 98 is a frictional member 100. Spring 96 is oriented in relation to housing 92 and lip 98 and frictional member 100 in such a way so that as a force is applied to frictional member 100, spring 96 will compress and as the force is removed from frictional member 100, spring 96 will release. However, lip 98 will eventually contact the material of housing 92 adjacent to opening 94 thus preventing spring 96 from extending beyond a predetermined point. In this embodiment, track 50 has a flat surface 51. Initial compression in spring 96 is such that when blind assembly 10 is positioned within track 50, frictional member 100 is forced against the surface of track 50. Alternately, no track may be used and the frictional contact will occur between frictional member 100 and the inside window mullion. The amount of force pushing frictional member 100 against track 50 together with the amount of friction between frictional member 100 and track 50 prevents bar 12 from moving within track 50 or inside window mullion. When the position of traveling bar 12 is to be changed, a manual force is applied to traveling bar 12 by either hand or pole contact to traveling bar 12 thus positioning traveling bar 12 to any location throughout the opening. When the manual force is removed from traveling bar 12 it will remain in the set fixed position. Traveling bar 12 can then be pivoted about pivot means 20 to the desired position. If desired, a spring loaded catch 90 could be attached to both bars 12 and 14.

In each of the embodiments, traveling bar 12 is capable of movement and bar 14 is fixed. However, both bars 12 and 14 could be movable, or fixed bar 14 could be the traveling bar and traveling bar 12 could be fixed.

While I have shown and described certain preferred embodiments of my invention, it should be distinctly understood that the invention is not limited thereto, but may be variously embodied within the scope of the following claims.

I claim:

1. In a window blind that has an elongated traveling bar and an elongated fixed bar, an arcuately collapsible pleated blind panel, one side of said panel being attached to said traveling bar and another side of said panel being attached to said fixed bar, a pivot means connected to the bottom end of each said bar so that said traveling bar may move angularly relative to said fixed bar, and a track for carrying said traveling bar, said track having a channel running therethrough, a system for effectuating the arcuate movement of said traveling bar through said track comprising:

a flat, elongated position slide having a cord tie off hole at one end and an elongated slot at the other;

a means for moveably attaching said position slide to a mounting face of said traveling bar so that the cooperation of said elongated slot and said fixing means allows said position slide to move back and forth in a predetermined amount across said mounting face, said position slide being placed at an end of said traveling bar opposite from said pivot means and being oriented with said cord tie off hole facing away from said pivot means; and an elongated cord connected to said position slide at said cord tie off hole and having a knot at some distance from said position slide, said cord and said knot traveling within said track channel.

2. The system of claim 1 also comprising a ring through which ends of said cord are laced.

3. The system of claim 1 also comprising a pair of rings each being laced through one ring and then fixed to one of said track and a surrounding window structure.

4. The system of claim 1 wherein ends of said cord hang freely from said track.

5. The system of claim 1 also comprising at least two fasteners passing through said elongated slot into said traveling bar.

6. An improved operable arch blind, comprising:

an elongated traveling bar and an elongated fixed bar, each said bar having a bottom end, an inner face and an outer face;

an arcuately collapsible, pleated blind panel having a bottom end, a top end, a first side, and a second side, the first side of said blind panel being fixed to the inner face of said traveling bar, the second side of said blind panel being fixed to the inner face of said fixed bar;

a flexible adhesive attached to the bottom end of said blind panel between said traveling bar and said fixed bar;

a pivot means connected the bottom end of said traveling bar to the bottom end of said fixed bar in a manner so that said traveling bar and said fixed bar may move angularly relative to one another by pivoting about said pivot means, causing said blind panel to collapse or extend;

a flat, elongated position slide having a cord tie off hole at one end and an elongated slot at the other;

a means for moveably attaching said position slide to a mounting face of said traveling bar so that the cooperation of said elongated slot and said fixing means allows said position slide to move back and forth in a predetermined amount across said mounting face, said position slide being placed at an end of said traveling bar opposite from said pivot means and being oriented with said cord tie off hole facing away from said pivot means; and an elongated cord connected to said position slide at said cord tie off hole and having a knot at some distance from said position slide, said cord and said knot traveling within said track channel.

* * * * *